United States Patent [19]

White

[11] Patent Number: 4,573,391

[45] Date of Patent: Mar. 4, 1986

[54] INFLATABLE KNOCK-DOWN GUITAR

[76] Inventor: Timothy P. White, 11000 Seymour Rd., Grass Lake, Mich. 49240

[21] Appl. No.: 595,718

[22] Filed: Apr. 2, 1984

[51] Int. Cl.[4] ..... G10D 1/08

[52] U.S. Cl. ..... 84/291; 84/293

[58] Field of Search ..... 84/267, 290–293, 84/298–299, 173

[56] References Cited

U.S. PATENT DOCUMENTS

| | | | |
|---|---|---|---|
| 476,083 | 5/1892 | Shattuck | 84/293 |
| 538,205 | 4/1895 | Back | 84/293 |
| 2,837,953 | 6/1958 | Baschet | 84/275 |
| 3,396,621 | 8/1968 | Dycus | 84/293 |
| 3,494,241 | 2/1972 | Jones | 84/307 |
| 3,771,408 | 11/1973 | Wright | 84/291 |
| 3,834,266 | 9/1974 | Robinson | 84/267 |
| 3,842,704 | 10/1974 | Prochilo | 84/267 |
| 3,910,151 | 10/1975 | Copeland | 84/267 |
| 4,073,211 | 2/1978 | Jorgensen | 84/291 |
| 4,111,093 | 9/1978 | Field et al. | 84/267 |
| 4,377,962 | 3/1983 | Parker | 84/269 |
| 4,433,603 | 2/1984 | Siminoff | 84/1.16 |

FOREIGN PATENT DOCUMENTS

| | | | |
|---|---|---|---|
| 349566 | 3/1922 | Fed. Rep. of Germany | 84/293 |
| 2263995 | 7/1974 | Fed. Rep. of Germany | 84/291 |
| 168733 | 9/1921 | United Kingdom | 84/173 |

*Primary Examiner*—Lawrence R. Franklin

*Attorney, Agent, or Firm*—Beaman & Beaman

[57] ABSTRACT

A guitar, preferably of the acoustic type, but adaptable for electrical amplification, wherein the guitar components may be readily disassembled and assembled to simplify handling and storage, the assembled components being maintained in their proper relationship by the tension of the strings. Acoustical quality is achieved by an inflatable bladder attached to the underside of the face panel, the bladder being encased within an envelope releasably affixed to the face panel periphery.

16 Claims, 5 Drawing Figures

INFLATABLE KNOCK-DOWN GUITAR

BACKGROUND OF THE INVENTION

Guitars generally consist of a body and an elongated neck whereby strings are tensioned between the neck headstock and the body face panel. The body, in an acoustical guitar, consists of spaced panels defining a resonance chamber to give the instrument the desired tonal qualities.

The rigid attachment of the neck to the body, and the size of the body, causes the guitar to be relatively large and cumbersome to handle, transport and store. However, the need for strength within the body and neck to produce the string tension, and the requirement for the resonant charber of the body has, in the past, dictated acoustical guitar construction and bulk.

While it is known to construct guitars with knock-down or folding necks, such as shown in U.S. Pat. Nos. 3,396,621; 4,073,211 and 4,111,093, such prior knock-down designs still result in a bulky size, and such guitars still require special carrying cases and special care when transporting.

Also, it is known to utilize an inflatable bladder as a resonance chamber for a guitar as shown in U.S. Pat. No. 2,837,953. However, the construction shown in this patent is not practical from a commercial standpoint, and this type of instrument has not been available.

It is a purpose of the invention to provide a knock-down guitar of either the acoustical or electrical type wherein the guitar components disassemble in such a manner as to permit the instrument to be placed within a conventional suitcase, eliminating the need for special carrying cases.

Another object of the invention is to provide a knock-down guitar utilizing a face panel, neck and headstock wherein these components are maintained in a rigid assembled condition by the tension within the strings interposed between the headstock and face panel mounted bridge.

Yet another object of the invention is to provide a knock-down guitar wherein string tension maintains the neck and body assembly, and quick string tensioning means are incorporated into the neck.

A further object of the invention is to provide a knock-down guitar having a two-piece face panel wherein the string bridge is utilized to maintain the assembly of the face panel portions.

An additional object of the invention is to provide an acoustical guitar with an inflatable bladder acoustical chamber which is maintained in vibration transmitting relationship to the face panel by a flexible envelope removably attached to the front panel periphery.

In the practice of the invention the rigid components consist of a two part face panel upon which the bridge is mounted by dovetail connections. The neck attaches to the face panel portions by a pin and dowel arrangement, and the headstock is attached to the neck in an adjustable manner by means of a cam mechanism whereby the headstock may be adjusted relative to the neck to simultaneously tension the strings interposed between the headstock and the bridge.

The interconnection between the headstock, neck, and face panels is of the compression type whereby string tension maintains the rigid assembly of these components.

The face panel portions are provided with a releasable envelope fastener, such as a slide fastener or Velcro, and the envelope forms a compartment at the underside of the face panel receiving a flexible, inflatable bladder which defines a resonant chamber in vibration transmitting relationship to the face panel.

Either an acoustical bridge or an electrical amplification bridge may be attached to the face panel, and converting the guitar from acoustical to electrical, or vice versa, may be readily accomplished.

The guitar components, when disassembled, may be readily packed within a conventional suitcase, and in the practice of the invention it is possible to store the guitar in considerably smaller space than heretofore possible.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
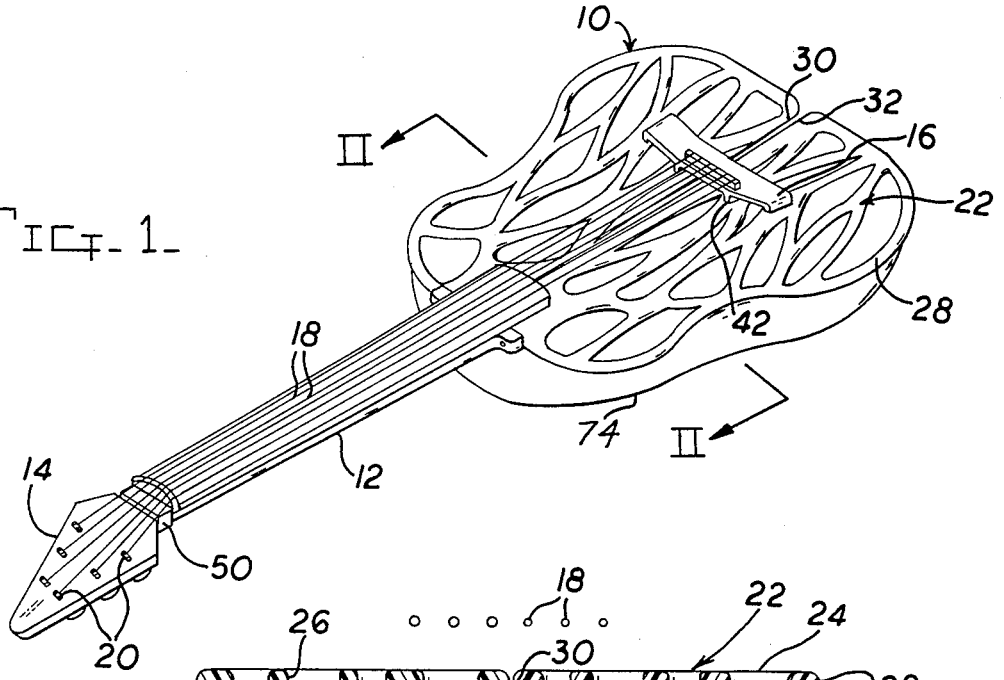
FIG. 1 is a perspective view of an assembled guitar in accord with the invention.

A guitar in accord with the inventive concept is shown in FIG. 1, and basically consists of a body 10, a neck 12, a headstock 14, bridge 16 and strings 18. The strings 18 are attached to the bridge 16 at one end, and at the headstock the strings are attached to the individual tighteners 20, which may be of conventional construction.

The body 10 includes a face panel 22 consisting of portions 24 and 26, which are the mirror image of each other. The face panel portions are preferably formed in the lattice configuration and of a synthetic material, such as fiberglass and resin, and the face panel includes a periphery 28 defined by the portions 24 and 26 when assembled along their mutual parting lines 30 and 32.

The portions 24 and 26 are each provided with a pair of dovetail recesses 34, and the portions are each recessed at 36 to receive the inner end 38 of the neck 12. The acoustical guitar bridge 16 is of an elongated form and on its upper side includes the string holders 40. On its underside four dovetail projections 42 are defined which mate with the face panel portions' dovetail recesses 34, and as the bridge 16 extends across both of the face panel portions 24 and 26 reception of the projections 42 within the recesses 34 will maintain the face panel portions in their assembled relationship as apparent in FIG. 1 engaging the parting line edges 30 and 32 of the portions as illustrated.

The neck squared inner end 38 is received within the face panel recesses 36, and dowels 44 extend through the neck wing 46 into holes 48 defined in the face panel to maintain the neck inner end within the face panel recess.

At its outer end, the neck 12 is provided with an angle block 50 which engages the outer end of the neck and includes a pair of elongated rectangular pins 52 received within neck slots 54. The retainer plate 56 attaches to the underside of the neck 12 overlapping the slots 54 to maintain the pins 52 within their slots, and a screw 58 holds the retainer 56 in place. The angle block 50 also includes two pins 60 extending in the direction of the headstock 14.

Figure 4:
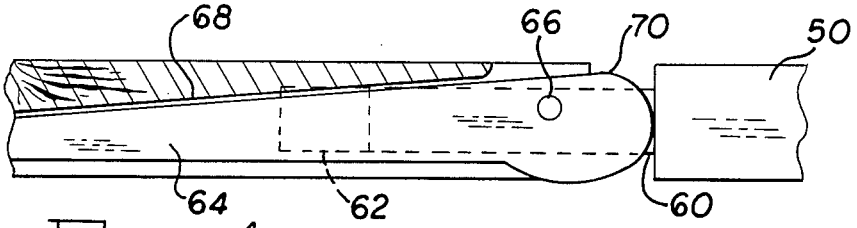
FIG. 4 is an elevational, enlarged, detail, partially sectional view of the headstock and neck assembly cam lever illustrating the cam lever in the string tensioning position.
Figure 5:
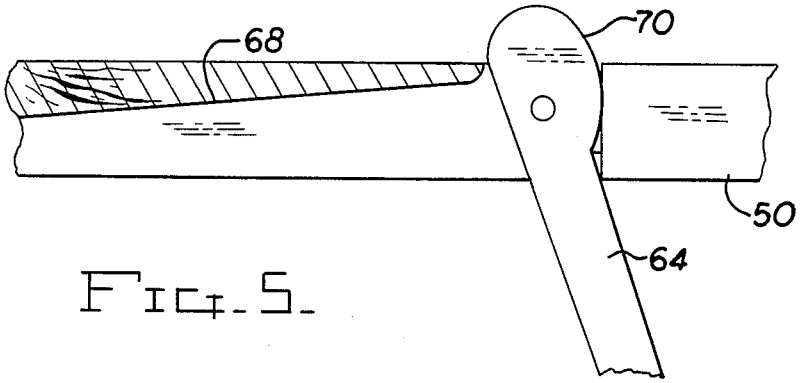
FIG. 5 is an elevational, detail, partially sectional view similar to FIG. 4 illustrating the headstock and neck in the string untensioned position.

The headstock 14 includes holes 62, FIG. 4, for receiving the angle block pins 60, and is provided with a recess 68 on its underside for receiving a tensioning lever 64 pivoted about pivot shaft 66. The tensioning lever 64 includes a convex cam surface 70 adapted to engage the angle block between the pins 60, and it will be appreciated that rotation of the lever 64 from the position of FIG. 5 to that of FIG. 4 will increase the distance between the angle block 50 and the headstock 14 thereby tensioning the strings 18 attached at their outer ends to the headstock mounted tighteners 20.

The periphery of the face panel portions 24 and 26 is provided with an envelope fastener 72, which may be in the form of one half of a slide fastener or "zipper" whereby a flexible envelope 74 may be attached to the face panel 22 by a mating slide fastener 76 affixed to the envelope periphery. The fastening means could also be in the form of Velcro components, snaps, or similar fasteners.

Figure 2:
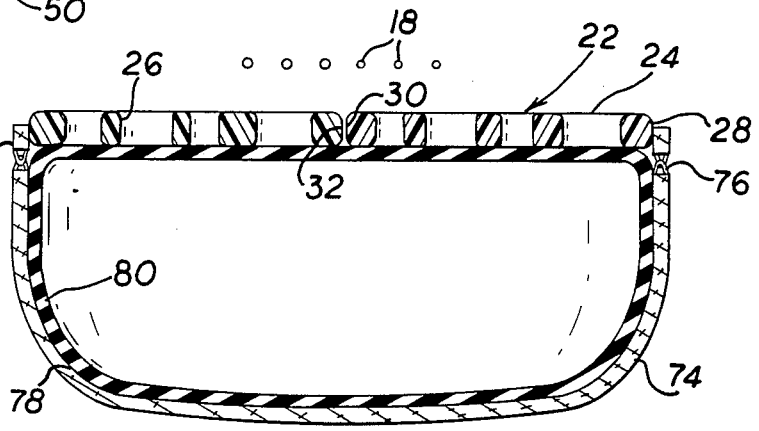
FIG. 2 is an elevational, sectional view as taken along Section II—II of FIG. 1.

The envelope 74 is formed of a flexible material, such as fabric, or synthetic plastic, and forms a compartment 78 receiving the inflatable bladder 80. The bladder 80 is formed of rubber, synthetic plastic, air-impervious fabric, or the like, and is dimensioned to fill the envelope compartment 78 and engage the underside of the front panel 22 when inflated, as apparent from FIG. 2. The bladder 80 may be inflated by blowing into the stem 82, and a simple valve, not shown, may be associated with the stem to retain the air.

In use as an acoustical guitar, the face panel portions 24 and 26 will be assembled by attaching the bridge 16 thereto by means of the dovetail recesses 34 and projections 42. The neck 12 is attached to the face panel by the dowels 44, and the headstock 14 attached to the angle block 50 which has been affixed to the neck. The strings 18 are attached to the bridge string holders 40, if they are not already affixed thereto, and assuming the strings to have been previously adjusted as to length, the headstock tensioning lever 64 will be in the position of FIG. 5 facilitating attachment of the strings to the bridge. Upon pivoting of the lever 64 to the position of FIG. 4, the strings 18 will be tensioned and only minor individual tensioning of the strings is required for tuning.

As the connections between the strings, bridge, and face panel, and the interconnections between the face panel and neck, neck and angle block, and angle block and headstock are all of the compression type, the tensioning of the strings 18 will maintain these components in a rigid assembly permitting the strings to be tensioned to the desired extent, and permitting the guitar to be held and played in the usual manner.

The envelope 74 is partially attached to the underside of the face panel 22 by the fasteners 72 and 76, and the bladder 80 is placed within the envelope. Thereupon, the envelope fasteners are fully connected, and the bladder inflated to the desired pressure. The instrument is now ready to be played, and is tuned by adjusting the individual string tensions in the normal manner.

Disassembly of the instrument is accomplished by reversing the above procedure, and as it will be appreciated that none of the components have a significant "depth", all of the components may be readily placed within a conventional suitcase or relatively flat box or package.

Figure 3:
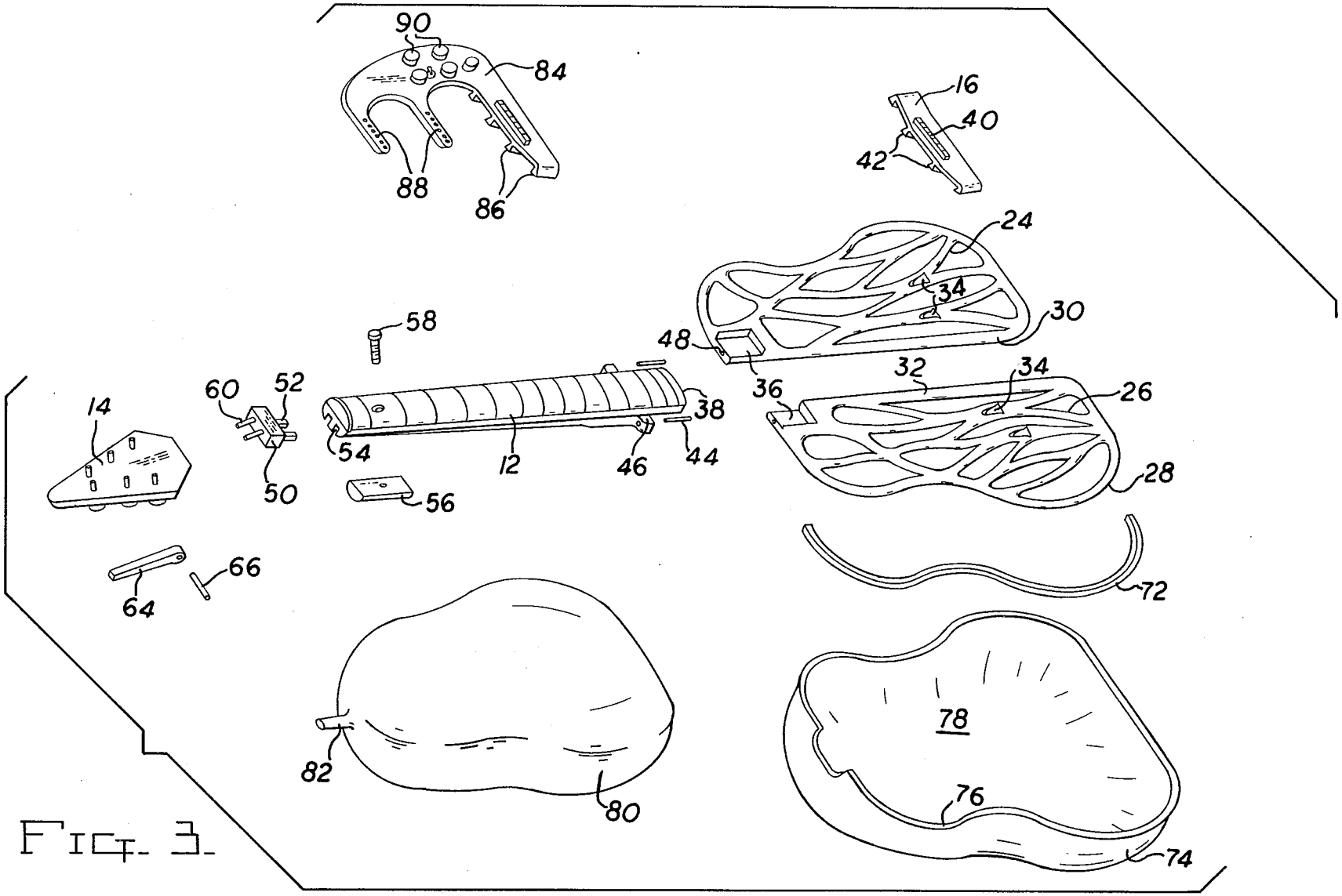
FIG. 3 is an exploded perspective view of the guitar in accord with the invention.

If it is desired to use the instrument as an electrical guitar, the electrical bridge 84, FIG. 3, is substituted for the acoustical bridge 16. The bridge 84 includes dovetail projections 86 which cooperate with the face panel recesses 34 in a manner identical to that described above. The bridge 34 includes string pickups 88 extending below the strings, and electrical adjustments are made through the control knobs 90 in the usual manner. When the guitar is being used with the electrical bridge 84 it is not necessary that the envelope 74 and bladder 80 be associated with the face panel, and if desired, the bladder and envelope may be omitted from the assembly.

It is appreciated that the invention provides a full size guitar which may be concisely stored or carried and various modifications to the inventive concepts may be apparent to those skilled in the art without departing from the spirit and scope of the invention.

I claim:

1. An inflatable guitar comprising, in combination, a face panel having a periphery, an outer side and an inner side, a bridge attached to said face panel outer side, an elongated neck attached to said face panel, strings extending between said bridge and neck, a flexible bladder envelope attached to the periphery of said face panel disposed adjacent said panel inner side, and an inflatable flexible bladder within said envelope in a vibration transmitting relationship to said face panel.

2. In an inflatable guitar as in claim 1, releasable envelope attachment means attached to said face panel periphery, said envelope having a periphery, and releasable attachment means defined on said envelope periphery for connection to said face panel envelope attachment means.

3. In an inflatable guitar as in claim 2, said envelope attachment means and releasable attachment means comprising a slide fastener.

4. A knock-down guitar comprising, in combination, a face panel, a string bridge mounted upon said panel adapted to attach strings to said panel, an elongated neck assembly removably attached to said panel, said neck assembly including a neck portion, a headstock portion, a panel end and a headstock end, string tension means defined on said headstock portion, a plurality of strings extending between said bridge and tension means, interlocking compression connection means defined upon said neck assembly panel end and said panel whereby the tension within strings interposed between said bridge and headstock maintains said neck assembly connected to said panel and release of string tension permits said neck assembly to be removed from said front panel, bridge connection means defined upon said face panel, releasable panel connection means defined upon said string bridge, said bridge panel connection means engaging said bridge connection means to mount said bridge upon said face panel, the tension within said strings maintaining said panel connection in engagement with said bridge connection means, said face panel comprising two substantially similar portions having a parting line generally parallel to the length of said neck assembly, said string bridge extending across said parting line, said bridge connection means being formed in both of said face panel portions whereby engagement of said bridge panel connection means with said bridge connection means maintains said face panel portions in assembled relation to each other.

5. In a knock-down guitar as in claim 4, said interlocking compression connection means including bores defined in said panel and neck assembly panel end having axes substantially parallel to the neck assembly length, pins within said bores, and engagable abutment surfaces defined upon said neck assembly panel end and panel transversely disposed to the neck assembly length.

6. In a knock-down guitar as in claim 4, adjustment means defined on said neck assembly for adjusting the length thereof providing simultaneous tensioning of said strings.

7. In a knock-down guitar as in claim 6, said headstock portion comprising a separate headstock portion movably mounted upon said neck portion for movement in the direction of the length of said neck assembly, said adjustment means being interposed between said headstock and said neck portion.

8. In a knock-down guitar as in claim 7, said adjustment means comprising a lever pivoted upon said headstock, a cam defined upon said lever engaging said neck portion.

9. In a knock-down guitar as in claim 4, said bridge connection means and said panel connection means comprising intermeshing dovetail components.

10. A knock-down guitar comprising, in combination, a face panel, said face panel having a periphery and an underside, a flexible envelope attached to said face panel periphery adjacent said underside, an inflatable baldder within said envelope in vibration transmitting relation to said face plate, a string bridge mounted upon said panel adapted strings to said panel, an elongated neck assembly removably attached to said panel, said neck assembly including a neck portion, a headstock portion, a panel end and a headstock end, string tension means defined on said heatstock portion, a plurality of strings extending between said bridge and tension means, and interlocking compression connection means defined upon said neck assembly panel end and said panel whereby the tension within strings interposed between said bridge and headstock maintains said neck assembly connected to said panel and release of string tension permits said neck assembly to be removed from said front panel.

11. In a knock-down guitar as in claim 10, releasable envelope attachment means attached to said face panel periphery, said envelope having a periphery, and releasable attachment means defined on said envelope periphery for connection to said face panel envelope attachment means.

12. In a knock-down guitar as in claim 11, said envelope attachment means and releasable attachment means comprising a slide fastener.

13. A knock-down guitar comprising, in combination, a face panel having a longitudinal central axis, said face panel comprising first and second portions lying in the same plane in side-by-side relationship, each portion having a lateral inner edge, said portions' lateral edges being in adjacent opposed relation defining a parting line coincident with said panel axis, an elongated string bridge mounted on said panel and transversely disposed to said panel axis, said bridge spanning said panel axis and portions' lateral edges, releasable cooperating attachment means defined upon said bridge and said panel portions releasably attaching said bridge upon said panel portions, an elongated neck assembly removably attached to said panel in alignment with said panel axis, said neck assembly spanning said parting line and being mounted upon both of said panel portions, a headstock defined on said neck assembly, string tension means defined on said headstock, and a plurality of strings extending between said string tension means and said bridge.

14. In a knock-down guitar as in claim 13, said panel portions each being defined by a plurality of elongated elements forming an open lattice having a periphery, said panel portions' lateral edges constituting a portion of each panel portion's periphery.

15. In a knock-down guitar as in claim 14, said panel portions being the mirror image of each other.

16. In a knock-down guitar as in claim 14, said panel portions being formed of a synthetic plastic material.

* * * * *